US010503198B2

(12) United States Patent
Wait et al.

(10) Patent No.: US 10,503,198 B2
(45) Date of Patent: Dec. 10, 2019

(54) GAS KNOB SKIRT RETAINER

(71) Applicant: Electrolux Home Products PTY LTD, New South Wales (AU)

(72) Inventors: David Wait, Dudley Park (AU); Purvag Nanavati, Dudley Park (AU)

(73) Assignee: Electrolux Home Products PTY Limited, Mascot, New South Wales (AU)

( * ) Notice: Subject to any disclaimer, the term of this patent is extended or adjusted under 35 U.S.C. 154(b) by 0 days.

(21) Appl. No.: 16/087,700

(22) PCT Filed: Mar. 24, 2016

(86) PCT No.: PCT/AU2016/050223

§ 371 (c)(1),
(2) Date: Sep. 24, 2018

(87) PCT Pub. No.: WO2017/161405

PCT Pub. Date: Sep. 28, 2017

(65) Prior Publication Data

US 2019/0094901 A1 Mar. 28, 2019

(51) Int. Cl.

| | |
|---|---|
| ***F24C 3/12*** | (2006.01) |
| ***G05G 1/08*** | (2006.01) |
| ***G05G 1/02*** | (2006.01) |
| ***G05G 1/10*** | (2006.01) |
| ***G05G 5/05*** | (2006.01) |
| ***G05G 9/04*** | (2006.01) |

(52) U.S. Cl.

CPC ..... *G05G 1/08* (2013.01); *F24C 3/126* (2013.01); *G05G 1/02* (2013.01); *G05G 1/10* (2013.01); *G05G 5/05* (2013.01); *G05G 9/04* (2013.01); *G05G 2505/00* (2013.01)

(58) Field of Classification Search

CPC .. G05G 1/08; G05G 1/10; G05G 5/05; G05G 9/04; G05G 2505/00; F24C 3/126

See application file for complete search history.

(56) References Cited

U.S. PATENT DOCUMENTS 2,501,008 A * 3/1950 Schramm ..... F16K 35/027 192/95
5,384,442 A * 1/1995 Danner ..... G05G 1/087 200/336

(Continued)

FOREIGN PATENT DOCUMENTS

GB 2109535 A 6/1983

OTHER PUBLICATIONS

International Search Report & Written Opinion issued in corresponding application No. PCT/AU2016/050223 dated May 27, 2016, 8 pages.

*Primary Examiner* — Vicky A Johnson
(74) *Attorney, Agent, or Firm* — Pearne & Gordon LLP

(57) ABSTRACT

A control knob assembly to control an operation of an appliance comprises a skirt adapted to engage the appliance. The skirt has a side wall, and a front face which in use will face away from the appliance. The assembly has a knob adapted to engage with the skirt, the knob having a side wall, the knob being adapted to move axially relative to the skirt. A spring is located between the knob and the skirt, to bias the knob and the skirt away from each other. The skirt and/or the knob has a spring retaining means adapted to retain the spring.

31 Claims, 8 Drawing Sheets

(56) References Cited

U.S. PATENT DOCUMENTS

| | | | | |
|---|---|---|---|---|
| 6,394,081 | B1 * | 5/2002 | Aguirre-Esponda ... | F24C 3/124 126/42 |
| 8,701,245 | B2 * | 4/2014 | Charlton ..... | A47L 9/0494 15/354 |
| 2007/0199806 | A1 | 8/2007 | Da Dalt et al. | |
| 2009/0151505 | A1 * | 6/2009 | Castillo ..... | G05G 1/12 74/553 |
| 2011/0072932 | A1 | 3/2011 | O'Keefe et al. | |

* cited by examiner

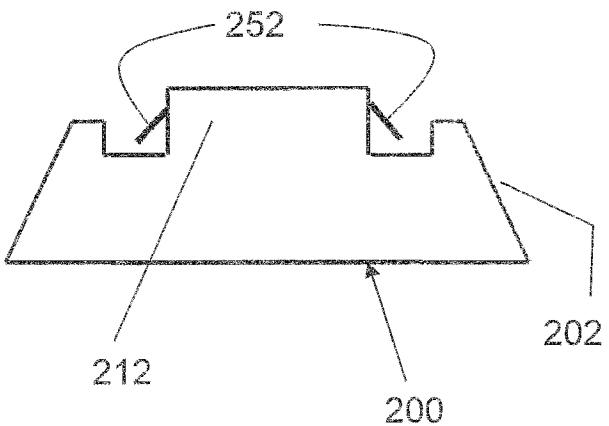
Figure 6a
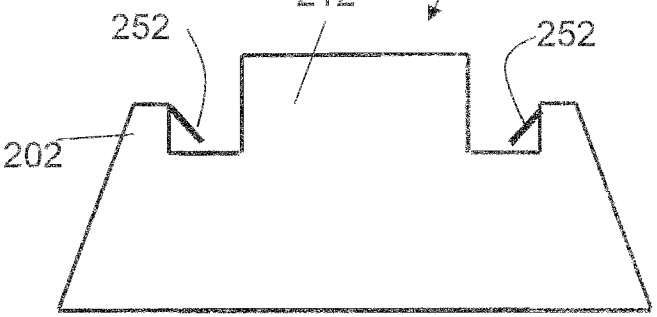
Figure 6b
Figure 5
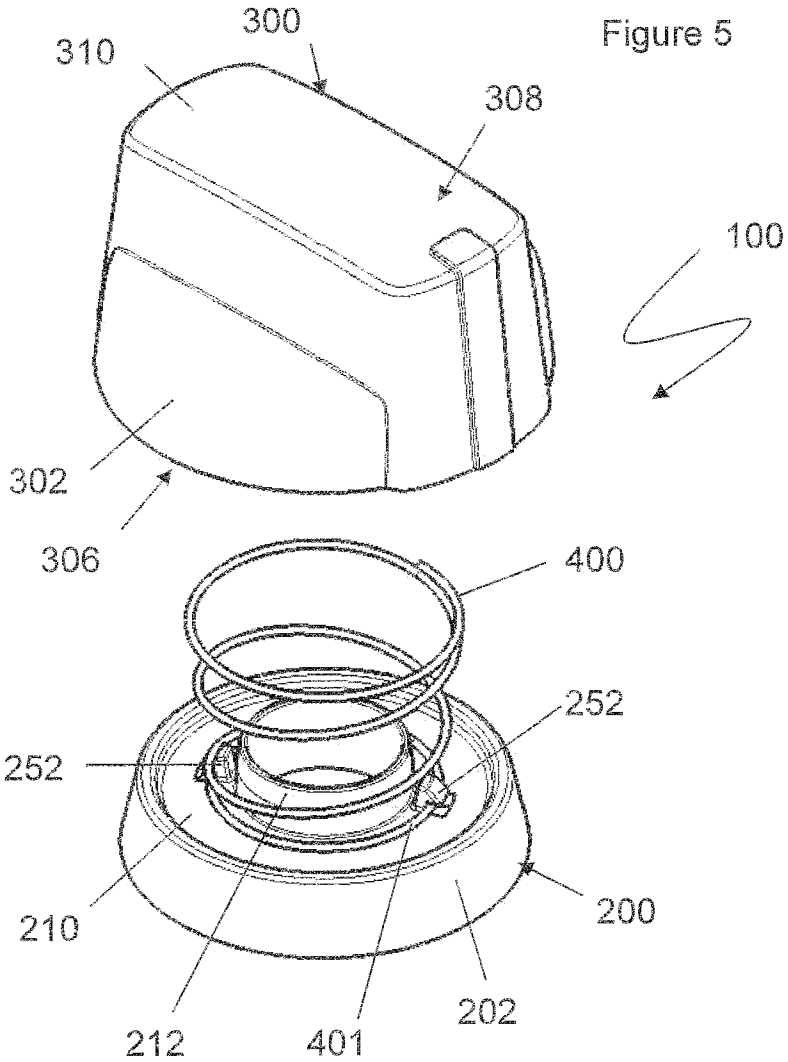

GAS KNOB SKIRT RETAINER

FIELD OF THE INVENTION

The present invention relates to cooking appliances, in particular to control knobs for gas cooking appliances.

BACKGROUND OF THE INVENTION

Gas cooking appliances are widely used due to the increasing availability in gas supply. The operation of gas cooking appliances in general requires the control of gas valves, which inter alia control the gas supply to gas burners of the gas cooking appliances. Control knobs or buttons are usually provided on the front or top panels of gas cooking appliances to allow user control of the gas ignition and flame control. A typical control knob operation allows a user to push the knob to first ignite the flame, and then turn the knob to control the size of the flame.

Some control knobs include compression springs against which the pushing operation is made, so that the control knob is biased away from the position which causes gas ignition. The knob, skirt and spring are aligned during installation. A misalignment will interfere with the installation and function of the control knobs, and make assembly difficult.

Any reference herein to known background does not, unless the contrary indication appears, constitute an admission that such background is commonly known by those skilled in the art to which the invention relates, at the priority date of this application.

SUMMARY OF THE INVENTION

In control knobs where springs are only held by being confined in delimited spaces which are provided when various control knob components are assembled, the springs become loose parts upon disassembly of the knob components. In control knobs where a locating sleeve, collar, or tube is provide, the locating sleeve, collar, or tube needs to face the right orientation for the spring to stay retained. The present invention ameliorates the problem by enabling alignment and retention of springs in control knobs.

The present invention provides a control knob assembly to control an operation of an appliance, comprising a skirt adapted to engage the appliance, the skirt having a side wall, and a front face which in use will face away from the appliance;

a knob adapted to interact with the skirt, the knob having a side wall, the knob being adapted to move axially relative to the skirt;

a spring located between the knob and the skirt, to bias the knob and the skirt away from each other;

the skirt and/or the knob having a spring retaining means adapted to retain the spring.

The skirt and the knob can both have spring retaining means.

Alternatively, only the skirt has spring retaining means.

Alternatively, only the knob has spring retaining means.

The spring retaining means can include a plurality of spring retainers.

The plurality of spring retainers can be angularly equidistant from each other.

The spring retaining means can be integrally formed.

The spring retainers can each have a component which is provided at an angle to a longitudinal axis of the control knob assembly.

The spring retaining means can include at least one groove to receive a partial portion of the spring.

In embodiments where the knob has spring retaining means, two or more of the plurality of spring retainers can be supported by the knob.

In embodiments where the knob has spring retaining means, two or more of the plurality of spring retainers can be located on a flange which extends from the knob.

In embodiments where the skirt has spring retaining means, two or more of the plurality of spring retainers can be located on the front face of the skirt.

In embodiments where the skirt has spring retaining means, two or more of the plurality of the spring retainers can be located on the skirt.

The skirt and the knob rotate independently of each other.

The skirt and the knob can alternatively rotate together.

The skirt can include a first formation, and the knob can include a second formation, wherein the first and second formations are aligned so that one is at least partially received by the other.

The first formation can be a spigot, projection, shaft, or protrusion, and the second formation can be a recess or an aperture.

The second formation can be a spigot, projection, shaft, or protrusion, and the first formation can be a recess or an aperture.

The first and second formations can be complementarily sized and shaped and rotating the knob will cause the second formation to drive the first formation, thus rotating the skirt.

The second formation can be adapted to be partially inserted into the first formation.

The first formation and the second central can be shafts.

The first formation can be a generally D-shaped shaft.

The first formations can include a relief recess formed into a side of the first formation.

The first formation and or the second formation is or are centrally located with respect to the skirt and or the knob.

The appliance can be a gas appliance and the knob or the skirt can be adapted to engage a stem of a gas valve of the gas appliance.

The knob can include a grip portion.

The skirt can include a rear face which in use will face the appliance, and rear extensions which extend away from the rear face and are proud of a rear rim of the skirt's side wall.

The skirt can be shaped and sized to be at least partially received by the sidewall of the knob.

The present invention also provides an appliance including one or more control knob assemblies mentioned above. The appliance can be a gas cooking appliance.

BRIEF DESCRIPTION OF THE DRAWINGS

An embodiment or embodiments of the present invention will now be described, by way of example only, with reference to the accompanying drawings, in which:

FIG. 5 is an exploded perspective view of a knob and a spring which is in a natural uncompressed state and retained on a skirt;

FIG. 6(*a*) is a schematic depicting a skirt having a plurality of alternative spring retainers;

FIG. 6(*b*) is a schematic depicting another skirt having a plurality of alternative spring retainers;

DETAILED DESCRIPTION OF THE EMBODIMENT OR EMBODIMENTS

Figure 1:
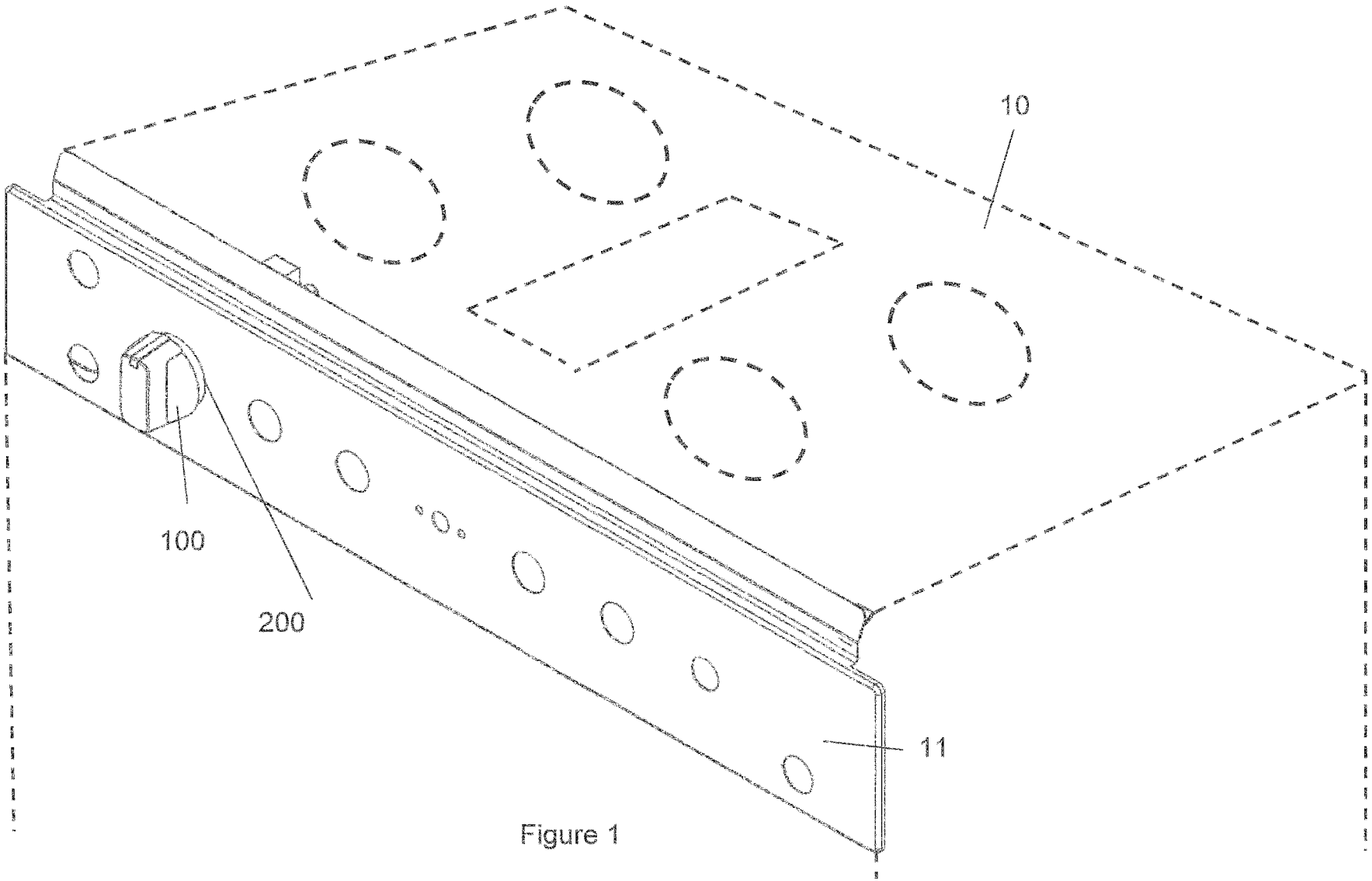
FIG. 1 is a perspective schematic of an appliance having a control panel with a control knob assembly mounted thereon which embodies the invention.

FIG. 1 depicts a control knob assembly 100 which is adapted to be mounted onto a panel 11 on an appliance 10. The appliance 10 can be a burner, cook top, barbecue, or the like, especially for gas cooking appliances. The appliance 10 is however not limited to being a cooking appliance. The control knob assembly 100 is used to control the operation of the appliance. Here one control knob assembly 100 is shown as being mounted onto a front panel 11 of the appliance 10. However, two or more control knob assemblies can be mounted to the appliance, and can be mounted to a different part of the appliance 10, e.g. a top panel.

For clarity and convenience, directional references such as "front" and "rear" will be used in this specification to describe the control knob assembly, to respectively refer to the parts of the control knob assembly components that are further and closer to the appliance.

As shown in FIGS. 2 to 6, a control knob assembly 100 includes a skirt 200, which is adapted to engage the appliance 10, in particular the rear of the skirt 200 is adapted to rest adjacent to or against the front or facia panel of the appliance. The control knob assembly 100 also includes a knob 300 which is adapted to interact with the skirt 200. The skirt 200 is shaped so as to be received within the base of the knob 300. A spring 400 is located between the skirt 200 and the knob 300. The spring 400 is a compression spring which tends to bias the skirt 200 and the knob 300 away from each other. A user manipulates the knob 300 to operate the appliance 10. By the pushing force applied by a user, the knob 300 can be moved axially toward the appliance 10, and to engage the gas valve stem in the appliance. Further pushing against the spring bias of the valve spring enables the ignition of the gas. The user also rotates the knob 300 as required to control the flame size. When the pushing force is removed, the bias of the valve spring in the appliance returns the knob 300 until it no longer pushes against the valve spring (not depicted). The bias of the spring 400 in the control knob assembly 100 returns the skirt 200 to its original axial position in relation to the knob 300. The knob 300 and the skirt 200 are therefore adapted to move axially relative to each other.

Figure 2:
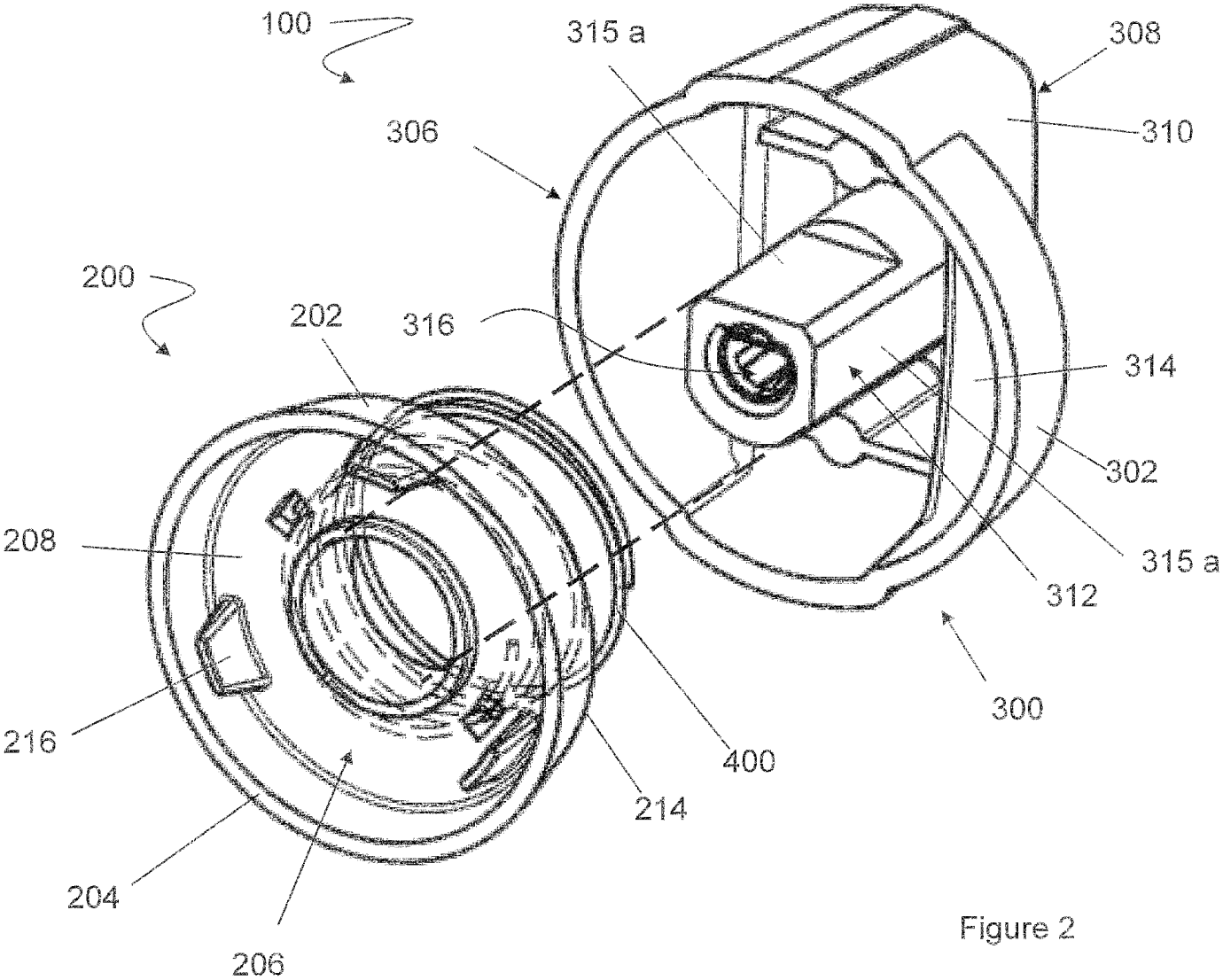
FIG. 2 is an exploded perspective view of a control knob assembly, with the spring being retained on the skirt.
Figure 4:
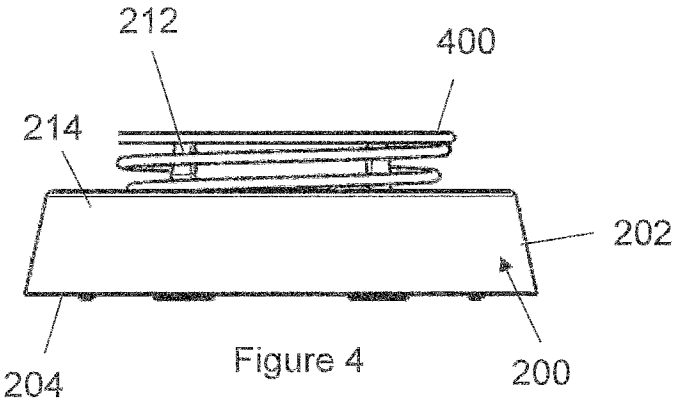
FIG. 4 is an elevation view of the assembly of the skirt and the compressed spring shown in FIG. 3.

As will be explained with reference to the later drawings, the skirt 200, the knob 300, or both, includes a spring retaining means or spring retaining arrangement to retain the spring 400. The spring retaining arrangement ensures the spring 400 is retained and properly aligned with respect to the skirt 200 or the knob 300, when the control knob assembly 100 is disassembled. It should be noted that in FIGS. 3 and 4, the spring 400 is shown in its compressed state. However, the skilled addressee will understand that when the components are removed, and the spring 400 is retained on the skirt 200 or the knob 300, in the absence of an externally applied force the spring 400 will be in its natural, relaxed state (as best illustrated in FIGS. 2, 5 and 6).

Further referring to FIGS. 2 to 5, the skirt 200 has a side wall 202, which generally defines the outer body of the skirt 200. The first formation 212 (best shown in FIG. 3) is surrounded by the side wall 202 of the skirt 200. In the depicted embodiment the side wall 202 is circular, but it can have other shapes, such as a square. The side wall 202 generally has a rear rim 204, which will be located closest to the appliance panel 11 (see FIG. 1) when the control knob assembly 100 is mounted on the appliance 10. Opposite the rear rim 204, the side wall 202 has a front rim 214 which in use will be located closer to the knob 300. The side wall 202 is provided around the centre or middle flange 206, which has a front face 210 and a rear face 208. The rear face 208 of the skirt 200 is visible in FIG. 2. The front face 210 of the skirt 200 can be seen in FIG. 3. The front face 210 of the skirt 200 in use will face away from the appliance 10. As shown, the skirt 200 further includes a first formation 212, visible in FIGS. 3 and 4, which extends from the front face 210 of the skirt 200.

As will be explained below, the first formations 212 of FIG. 2 receives or has passing through it, a second formation 312 on the knob 300, or vice versa, namely the mechanical inverse.

Optionally, the first formation 212 has a relief recess or relief opening 218 (visible in FIG. 3) formed into an end rim 220 at a free end. The relief recess 218 provides a relief area to ensure the knob 300 and the skirt 200 do not bind together, which would hinder the axial movement of the knob 300 relative to the skirt 200, and also hinder disassembly of the parts. It will be understood that in embodiments where the first formation 212 is inserted into the second formation 312, the relief recess can alternatively be provided in the second formation 312.

In the depicted embodiments, the first formation 212 is a centrally located shaft, spigot, projection, or protrusion with respect to the side wall 202 of the skirt 200. The complementary second formation 312 is a recess, aperture, or passage which at least partially receives the first formation 212. In the embodiments depicted in FIG. 2, the complementary second formation 312 is the passage within a central shaft with respect to the side wall 302 of the skirt 300. For embodiments which are suitable for use with gas appliances, the first and second formations 212, 312 have aligned passages to accommodate e.g. a gas tap or gas valve stem. As shown in FIG. 2, the second formation 312 in the knob 300 further includes a longitudinal passage 316. Upon assembly of the knob 300 with the skirt 200, the longitudinal passage 316 in the knob 300 will align with the longitudinal passage 222 in the skirt. The control knob assembly 100 will be mounted onto the appliance so that the aligned passages will receive the gas tap.

As seen in FIG. 2, the skirt 200 includes a plurality of rear projections 216 which extend away from the rear face 208. The rear projections 216 are located inwardly from the rear rim 204 and are even spaced from one another. In this case three rear projections 216 are included. However a different number of rear projections 216 may be provided. The projections 216 extend proud of the rear periphery of rim 204 of the skirt's side wall 202, usually by about 1 to 2 mm. Therefore, when the skirt 200 is mounted on the appliance's facial panel 11 (see FIG. 1), or when it is being rotated in use, the projections or tabs 216 engage the facia panel 11, so scratching or other marks left by the rear projections or tabs 216 will remain hidden rather than exposed, as would be the case for scratching or markings that may be caused by the rim 204 of the skirt 200. The scratches or markings are out of view from the vision of a user as they will be located inward of the rear rim 204. The scratches or markings will only become visible when the skirt 200 is removed.

As seen in FIGS. 2 to 5, the skirt 200 has a spring retaining means 250, which retains the spring 400 on the skirt 200, in the aligned position that is required for the control knob assembly 100 to be assembled. The circumferential periphery of the spring 400, being retained by the spring retaining means 250, does not become a loose part or deviate from its aligned position when the skirt 200 and the knob 300 are disassembled. This is achieved by the diametrical distance between the spring retaining means 250 being slightly greater than the natural diameter of the base of the spring 400, so that the circumferential spring tension will maintain the spring 400 on the spring retaining means 250 of the skirt 200. As a result, the process of mounting the control knob assembly 100 on the appliance panel is simplified, as a subassembly is made and the spring does not need to be manually held in position during assembly of the knob 300 and the skirt 200. Furthermore, the potential for the spring 400 to come loose and separated is obviated.

In the preferred embodiment, the spring retaining means 250 is located on the front face 210 of the skirt 200. It includes one or a plurality of spring retainers or spring retaining formations 252. Here the preferred spring retainers 252 are generally L-shaped formations, where a part of the L provides a portion which is at approximately 90 degrees to the rotation axis of the skirt 200 or the knob 300. The spring retainers 252 are provided at diametrical locations and are angularly equidistant from each other, to evenly hold the spring coil 400 on the skirt 200. Two spring retainers 252 are depicted, but three or more spring retainers can be provided. In FIG. 2, the spring is shown in dashed lines as it is obscured by the skirt 200 in the depicted view.

Figure 3:
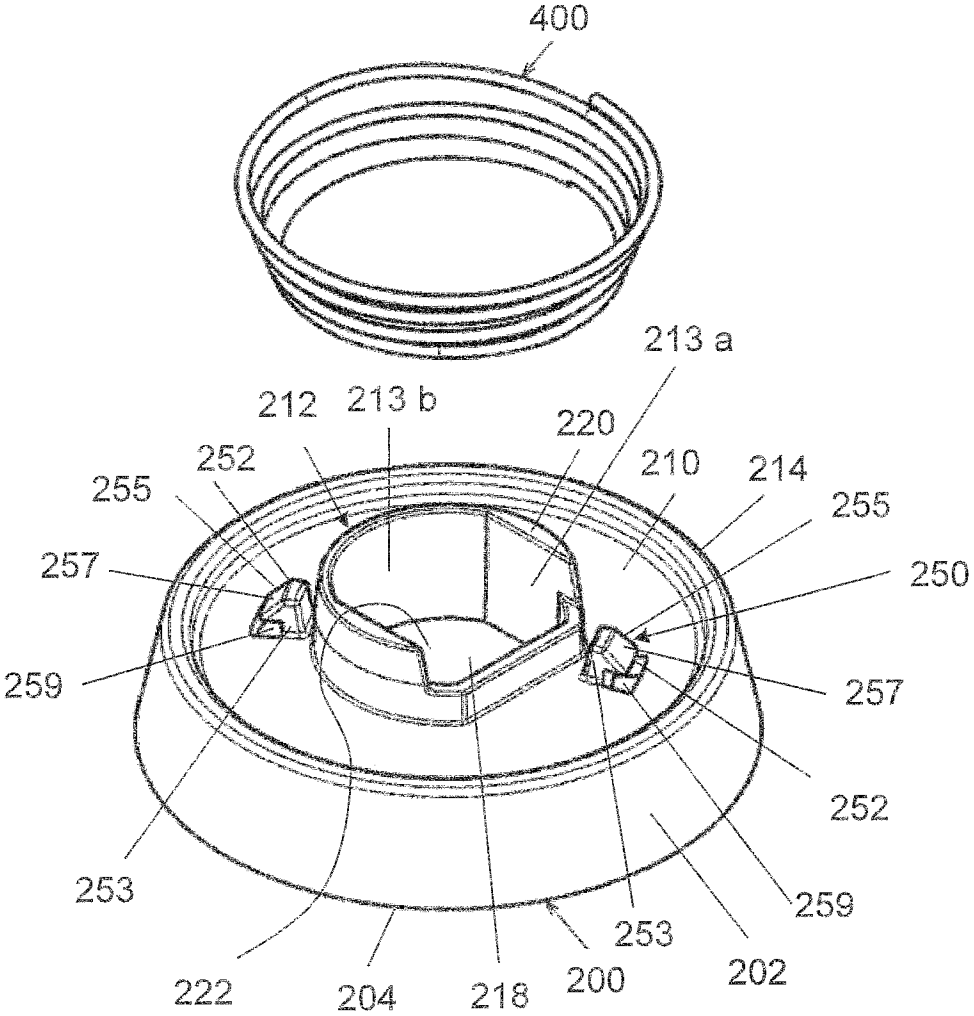
FIG. 3 is an exploded perspective view of the skirt and the spring shown in FIG. 2, with the spring shown in the compressed state but should be uncompressed.

The generally L-shaped spring retaining formations 252 are best shown in FIG. 3. In this example, the spring retaining means 250 includes two integrally formed or moulded retainers 252 which are located on either side of the first formation 212, and are diametrically opposed from each other. Each retainer 252 includes an arm 253 which extends away from the front face 210 of the skirt 200. The arm 253 extends into a return elbow 255 which projects outwards toward the front rim 214. The return elbow 255 has a chamfered surface 257 which slopes toward the front face 210 of the skirt 200, but the return elbow 255 remains proud of the front face 210, leaving a clearance 259 between the return elbow 255 and the front face 210 of the skirt 200. In use, the base coil(s) 401 of the spring 400, being the coil(s) that will be positioned closest to the front face 210 of the skirt 200 in use, is pushed down the chamfered surface 257 and toward the front face 210. The two return elbows 255 are positioned so that the chamfered surfaces 257 are separated by a distance that is less than the diameter of the spring coils. That is, the retainers 252 lie on an imaginary circle whose diameter is the same as or less than the natural diameter of the spring coils. Therefore, as the spring coil is pushed toward the front face 210, it is made to ride down the chamfered surfaces 257 of the return elbows 255. The resilient arms 230 are deflected by the pushing force to accommodate the circumference of the spring coil 401. Once the spring coil clears the return elbows 255 and enters the clearance 259, the resilient arms 230 returns to their original positions. The spring coil is then caught and thus retained between the spring retaining clips 252. Alternatively, a user may hook a base spring coil under the return elbow 255 of one of the spring retainers 252, stretch the coil until it clears the opposite return elbow 255, then release the spring coil. The spring coil will return to its original shape and be captured by the spring retaining means 250. FIG. 5 depicts the spring 400 being retained on the skirt 200, where the base coil 401 is captured by the spring retainers 252.

The spring retainers or spring retaining formations 252 can be provided at other locations in the skirt 200. For example, in FIGS. 6(*a*), the spring retainers 252 are provided at an inner location of the skirt 200. In FIG. 6(*b*), the spring retainers 252 are provided projecting inwardly from an outer location towards formation 212. Regardless of the exact locations of the spring retainers 252, each spring retainer has a component that is radial or perpendicular to the longitudinal axis of the skirt 200 and thus the longitudinal axis of the spring 400. The radial or perpendicular components capture or hook the spring 400 onto the skirt 200.

Figure 7:
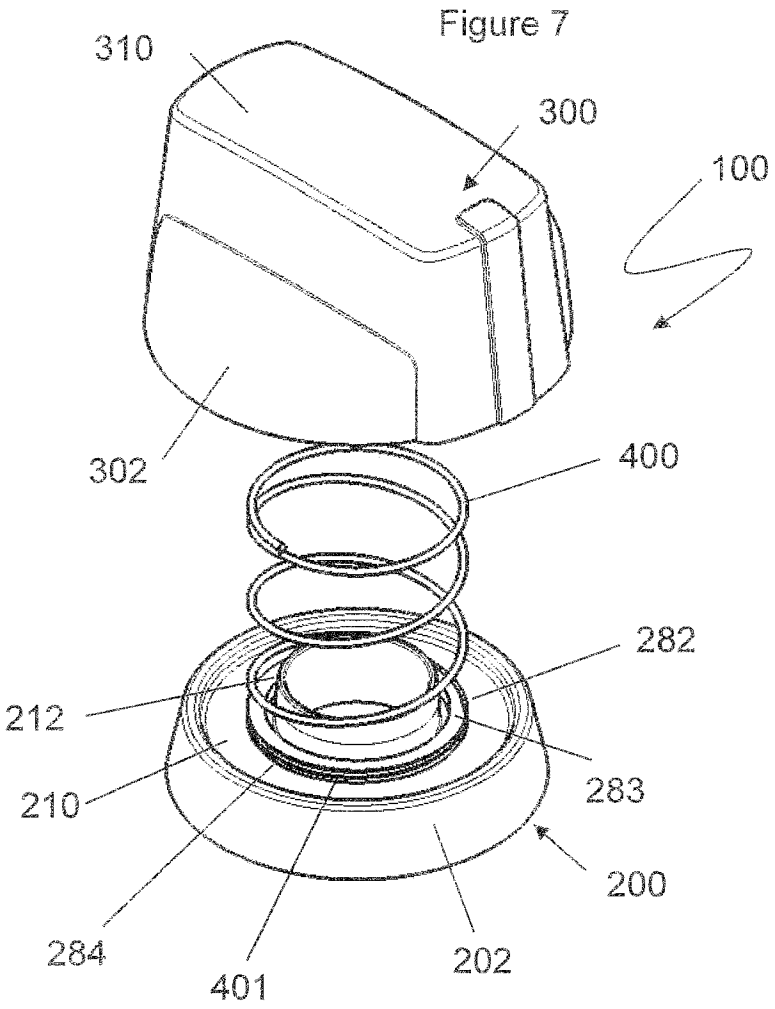
FIG. 7 is an exploded perspective view of a knob and a spring shown in a natural uncompressed state to be retained on a skirt according to another embodiment.

FIG. 7 depicts a further alternative embodiment of a skirt 200, which has a different spring retaining means. Here the skirt 200 includes a collar 282 which projects from the front face 210 of the skirt 200. The collar 282 has a groove or grooves 284 formed into its surface. The base of the groove 284 has a diameter which is the same as or smaller than the nominal diameter of the spring 400 when the spring is in its natural, relaxed state. Here the one or more grooves are formed into the exterior surface. The one or more grooves are matching groove(s) with the spring coil 401 so as to partially receive and retain a portion of the spring 400 within the groove 284. A front surface 283 of the collar 282 can be bevelled or chamfered, being sloped toward the side wall 202 and the front face 210 of the skirt. The spring coil 401 is expanded as it is pushed past the front surface 283. The elasticity of the spring coil 401 then causes the coil 401 to reduce in size and to be captured within the groove 284. Therefore, circumferential spring forces help to keep the spring 400 and skirt 200 together. The groove(s) 284 formed into the skirt 200 are the radial or perpendicular component(s) which capture the spring 400.

Figure 8:
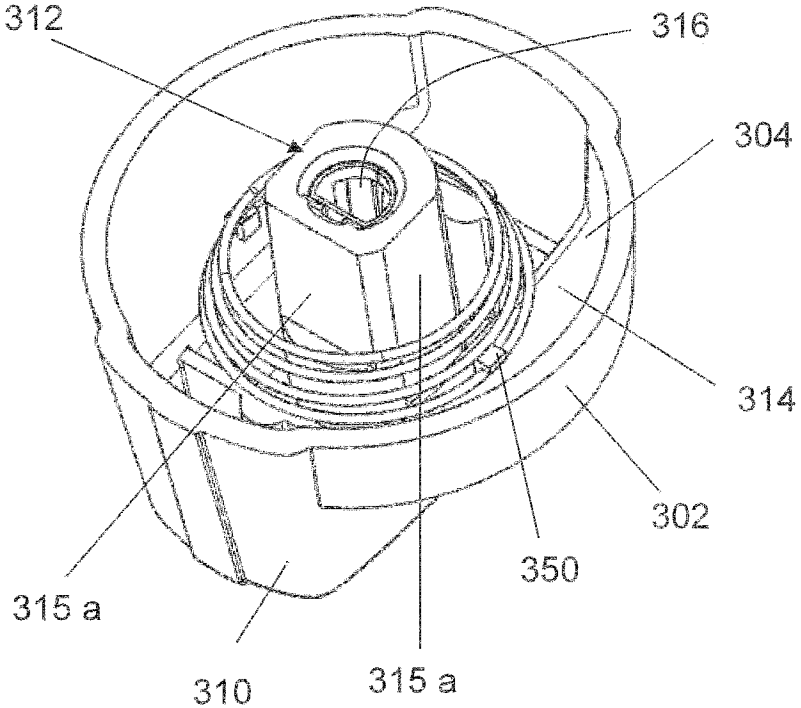
FIG. 8 is an exploded perspective view of another embodiment of the skirt, spring, and knob assembly, with the spring being shown in a compressed state and retained by the knob.
Figure 8:
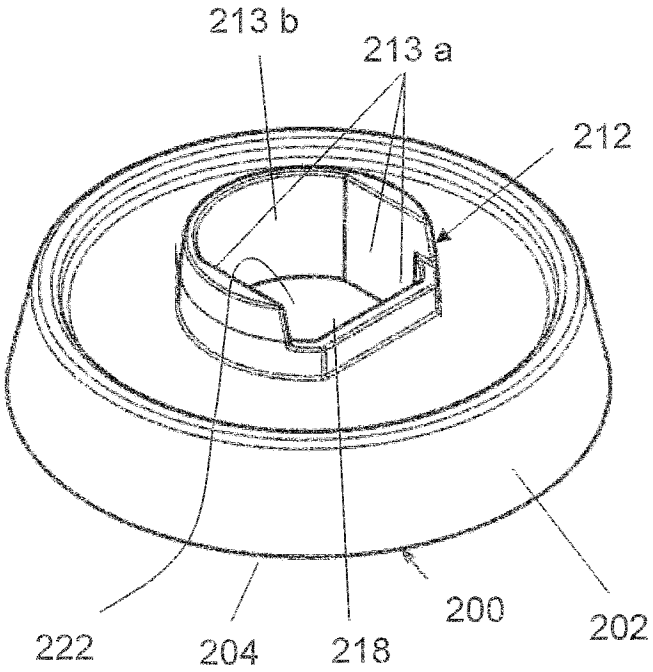
Figure 9:
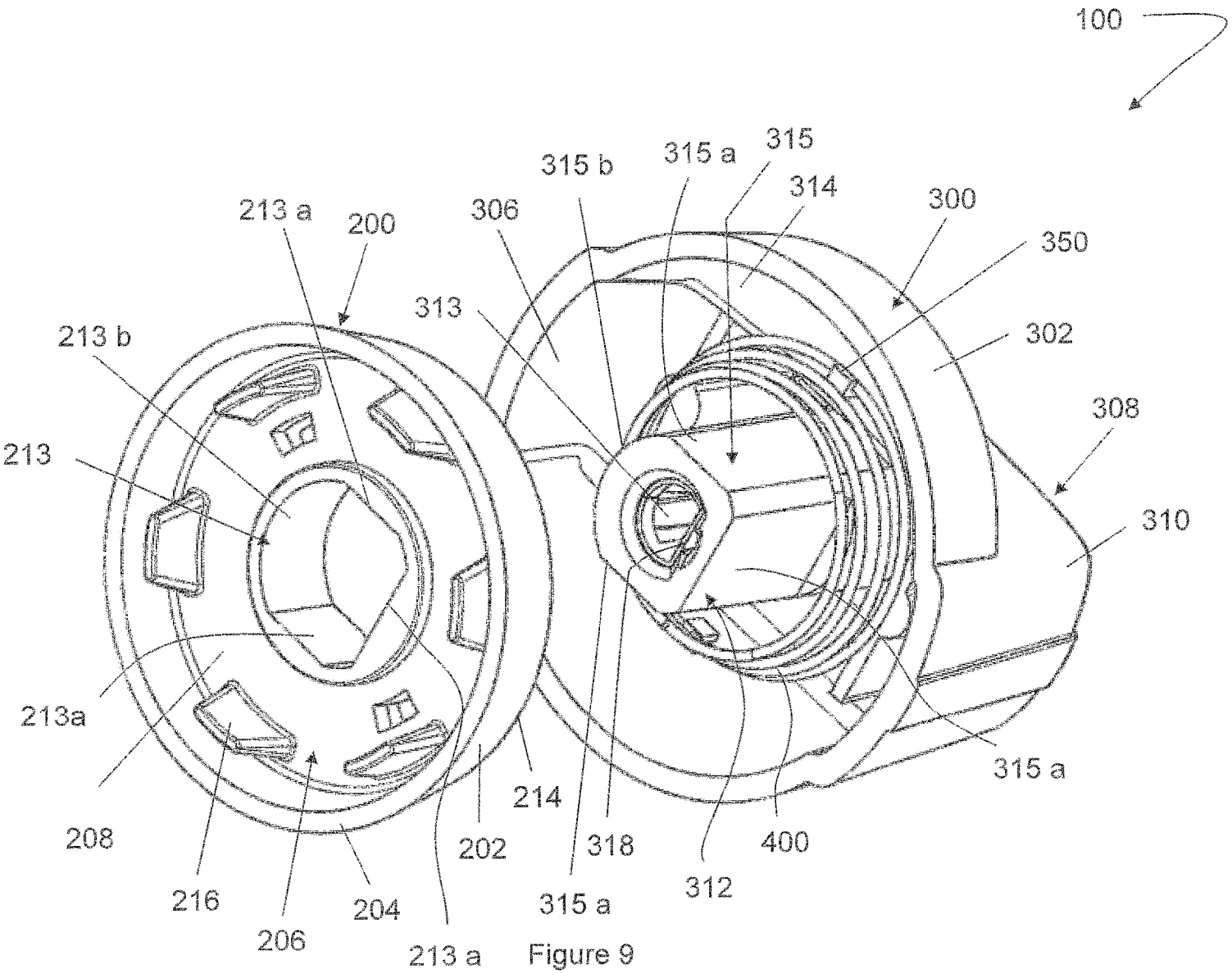
FIG. 9 is an exploded rear perspective view of a further embodiment of a control knob assembly, with the spring in its natural uncompressed state being retained on the knob.

As visible in FIGS. 2, 8, and 9, a flange 314 extends inwardly from the side wall 302 of the knob 300. The flange 314 is supported by the sidewall 302.

Figure 11:
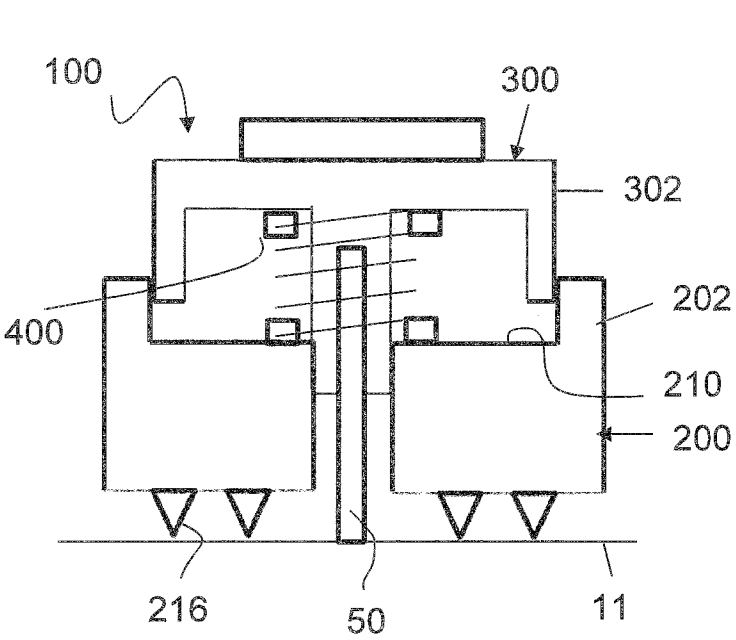
FIG. 11 is a schematic depicting another alternative skirt, spring and knob assembly.
Figure 10:
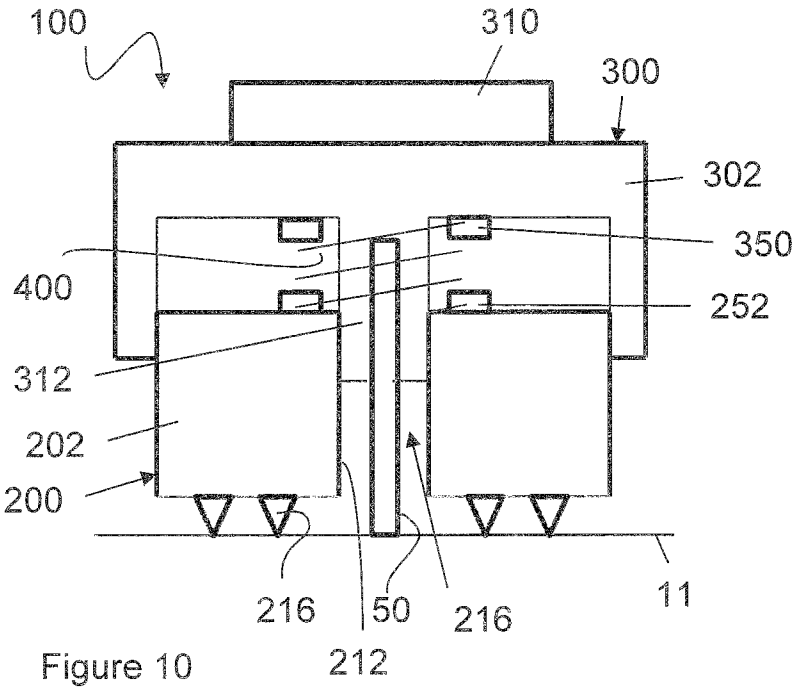
FIG. 10 is a schematic depicting an alternative skirt, spring and knob assembly.

As shown in FIG. 8, spring retaining means 350 are provided on knob 300. The spring retaining arrangement 350 includes a plurality of spring retainers 350, in this case two, evenly spaced from each other and located on the flange 314. The spring retainers 350 are the same as the retainers 252 provided in the embodiment shown in FIGS. 2 to 5, but are located on the knob 300 instead of the skirt 200. The spring retainers 350 as shown are integrally formed or moulded clips which retain or hold the spring coil. An alternative spring retaining means is a groove which matches the spring coil, formed into an inside surface of the knob, similar to the groove 284 provided on the skirt shown in FIG. 7. FIGS. 9 to 11 depict further embodiments where both the knob 300 and the skirt 200 have spring retaining means 350, 250. In a further alternative, the spring retainers 350 are directly supported by the sidewall 302 of the knob 300. Each retainer 350 is or has a component that is radial to the longitudinal axis of the knob 300. As shown for example in FIG. 12, each spring retainer 350 has a component extending from sidewall 302 in a direction that is at an angle to the longitudinal axis of the knob 300, to each form a hook or a hooked end, to together retain the end coil(s) of the spring 400. The angle can be an acute angle, that is less than 90 degrees as illustrated or at right angles or may be an obtuse angle.

The knob 300 will now be described with reference to FIGS. 2, 8, and 9. The knob 300 has a rear side 306 that will be positioned toward the skirt 200 and a front side 308 that will be oriented away from the skirt 200, when it is assembled onto the skirt 200. The knob 300 includes a side wall 302. In the depicted embodiment, the side wall 302 defines a circular shape to match with that of the side wall 202 of the corresponding skirt 200. However, in alternative embodiments it is possible for the skirt 200 to have a front recessed portion to receive the knob 300 (e.g. see FIG. 11). A grip portion 310 is provided on the knob 300, for easy handling and manoeuvering of the control knob assembly 100 by a user. The grip portion 300 is located on the front 308 of the knob 300, but alternatively, can extend from the side wall 302 of the knob 300.

The side wall 302 is annular and surrounds a recessed portion 304 into which the skirt 200 can move. The knob 300 and the skirt 200 are shaped and sized, so that the skirt 200 is at least partially received by the recessed portion 304 of the knob 300. Also, the side wall 302 of the knob 300 surrounds a second formation 312, which in use will mate or engage with the first formation 212 of the skirt 200. An internal surface 313 of the second formation 312 in the knob 300 has a driving surface 318 which engages and drives the valve stem (not shown), so that rotating the knob 300 will rotate the valve stem.

In the embodiments shown in FIGS. 3, 8, and 9, the first formation 212 in the skirt 200 engages the second formation 312 in the knob 300 so that rotating the knob 300 will drive the skirt 200, or vice versa. The first and second formations are aligned, so that one is at least partially received by the other. In the depicted embodiment, the first formation 212 is adapted to partially receive the second formation 312, when the latter is inserted into the former 212. Therefore, in the embodiments shown in FIGS. 3, 8 and 9, the internal surface 213 of the first formation 212 on the skirt 200 is sized and shaped to correspond to the external surface 315 of the second formation 312 in the knob 300. The arrangement where the first formation 212 partially receives the second formation 312 is also depicted in the schematic shown in FIGS. 10 and 11.

The first and second formations are complementarily sized and shaped. In the embodiments shown in FIGS. 3, 8, and 9, the internal surface 213 of the skirt mating (i.e. first) formation 212, and the external surface 315 of the knob mating (i.e. second) formation 312, are generally D-shaped. The external surface 315 of the second formation 312 is shown as having three straight sides 315*a* and one curved side 315*b*. The internal surface 213 of the first formation also has three straight sides 213*a* and one curved side 213*b* to match. Each of the straight sides 315*a* on the second formation 312, matched with a corresponding straight side 213*b* on the first formation 212, provides a driving key whereby a rotation of the second formation 312 drives the first formation 212 to also rotate. The D shape can be slightly different, having for example only one driving surfaces rather than three. The external surface 315 of the second formation 312 and the internal surface 213 of the first formation 212 do not need to be generally D-shaped. What is required is that the skirt 200 and the knob 300 are desired to rotate together, then the engaging surfaces 315, 213 need to have complementary driving surfaces. The driving surfaces further need not be straight sides.

The control knob assembly 100 is a rotary knob. In the embodiments depicted in FIGS. 3, 8, and 9, the first formation 212 and second formation 312 are complementarily sized and shaped, so that rotating the knob 300 will cause the second formation 312 to drive the first formation 212, thus rotating the skirt 200. In the embodiment of FIGS. 3, 8, and 9, the second formation 312 is a generally D-shaped shaft which is in use inserted into a complementary longitudinal passage 222 with a D-shaped cross section, in the first formation 212. Another shape can be used for the shaft and passage combination to enable the first and second formations to rotate together, as long as the shape includes a driving portion so that one formation will drive the other. In embodiments shown in FIGS. 3, 8, and 9, the first formation 212 is centrally located with respect to the skirt 200, and the second formation 312 is centrally located with respect to the knob 300. However one or both of the formations 312, 212 which provide the driving engagement between the skirt 200 and the knob 300 can be located off centre.

In embodiments where the skirt 200 and the knob 300 are not required to rotate together, the external surface 315 of the second formation 312 and the internal surface 213 of the first formation 212 need not have driving surfaces to engage each other. For instance, in the embodiments depicted in FIGS. 2, 5 and 7, the internal surfaces 213 of the first formations 212 are round and do not include any surface for driving engagement with the second formations 312Therefore in the embodiments shown in FIGS. 2, 5, and 7, the skirt 200 and the knob 300 will not rotate together, that is, they will rotate independently of each other, because the first formation 212 will rotate without driving the second formation 312 and vice versa.

Is not necessary for the skirt 200 to include a first formation 212 that extends from the front surface 210. For example, as seen in FIG. 10, the second formation 312 is a shaft, spigot, projection, or protrusion, which has an internal passage 316 to drive the valve stem 50. The first formation 212 in the skirt 200 is an aperture, recess or through passage which aligns with the shaft 312. In embodiments where the skirt formation 212 and the knob formation 312 do not have cooperating engaging surfaces, rotating the knob 300 will not cause the skirt 200 to rotate. FIG. 11 shows a schematic of an assembly similar to that shown in FIG. 10, except that the sidewall 302 of the knob 300 is located within the sidewall 202 of the skirt 200 when the knob 300 and the skirt 200 are assembled. The size of the spring 400 and the depth of the knob sidewall 302 are chosen so that the bias of the spring 400 keeps the knob sidewall 302 from reaching the front face 210, allowing the knob 300 to be pushed toward the skirt 200 against the spring bias.

Figure 13:
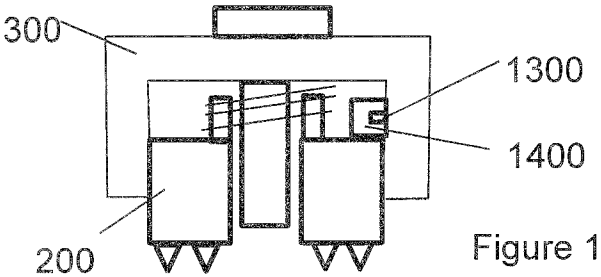
FIG. 13 is another knob and skirt construction.
Figure 12:
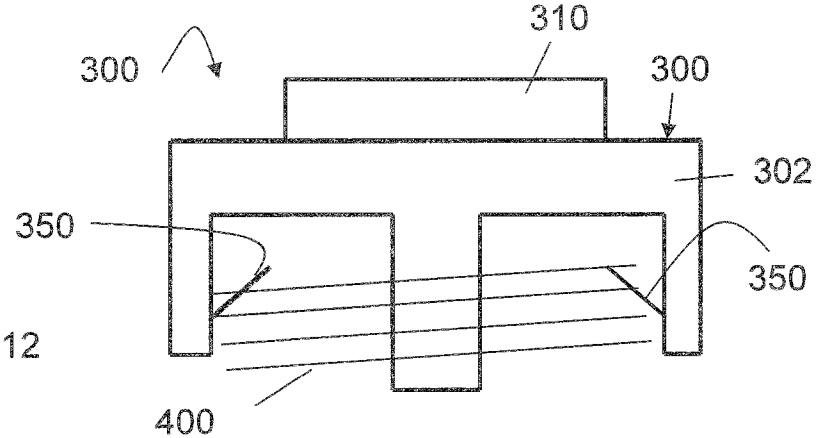
FIG. 12 is a schematic depicting another alternative knob.

It is appreciated that in the embodiments described above, the first and second formations 212 and 312 enable the mounting relationship between the knob 300 and the skirt 200. The mounting between the knob 300 and the skirt 200 can also be achieved by the respective sidewalls of the skirt 200 and the knob 300 as shown in FIGS. 11 and 12. The first and second formations serve the further function of allowing the knob or the skirt to engage the gas valve stem of the gas appliance. A third function performed by the first and second formations is that they provide complementary engaging portions so that rotating the knob 300 will cause the skirt 200 to also rotate. It will be appreciated that the aforementioned third function can instead be provided by an alternative formation in the skirt 200 or the knob 300, which may or may not be centrally located. For example, as shown in FIG. 13, the skirt 200 and the knob 300 respectively have off-centred engagement formations 1400, 1300, which enable the skirt 200 to rotate when the knob 300 is rotated.

Where ever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A control knob assembly to control an operation of an appliance, comprising:

a skirt adapted to engage the appliance, the skirt having a side wall, and a front face which in use will face away from the appliance;

a knob adapted to interact with the skirt, the knob having a side wall, the knob being adapted to move axially relative to the skirt; and a spring located between the knob and the skirt, to bias the knob and the skirt away from each other;

the skirt and/or the knob having a spring retaining means adapted to retain the spring, and the skirt being shaped and sized to be at least partially received by the sidewall of the knob.

2. The control knob assembly as claimed in claim 1, wherein the skirt and the knob both have spring retaining means.

3. The control knob assembly as claimed in claim 1, wherein only the skirt has spring retaining means.

4. The control knob assembly as claimed in claim 1, wherein only the knob has spring retaining means.

5. The control knob assembly as claimed in claim 1, wherein the spring retaining means includes a plurality of spring retainers.

6. The control knob assembly as claimed in claim 5, wherein the spring retainers each have a component which is provided at an angle to a longitudinal axis of the control knob assembly.

7. The control knob assembly as claimed in claim 5, wherein two or more of the plurality of spring retainers are supported by the sidewall of the knob.

8. The control knob assembly as claimed in claim 5, wherein two or more of the plurality of spring retainers are located on a flange which extends from the sidewall of the knob.

9. The control knob assembly as claimed in claim 5, wherein two or more of the plurality of spring retainers are located on the front face of the skirt.

10. The control knob assembly as claimed in claim 5, wherein two or more of the plurality of the spring retainers are located on the sidewall of the skirt.

11. The control knob assembly as claimed in claim 5, wherein the plurality of spring retainers are angularly equidistant from each other.

12. The control knob assembly as claimed in claim 1, wherein the spring retaining means is integrally formed.

13. The control knob assembly as claimed in claim 1, wherein the spring retaining means include at least one groove to receive a partial portion of the spring.

14. The control knob assembly as claimed in claim 1, wherein the skirt and the knob rotate independently of each other.

15. The control knob assembly as claimed in claim 1, wherein the skirt and the knob rotate together.

16. The control knob assembly as claimed in claim 1, wherein the skirt includes a first formation, and the knob includes a second formation, wherein the first formation and the second formation are aligned so that one is at least partially received by the other.

17. The control knob assembly as claimed in claim 16, wherein the first formation is an aperture or a recess and said second formation is a spigot, projection, shaft or protrusion.

18. The control knob assembly as claimed in claim 16, wherein the first formation and the second formation are complementary, and rotating the knob will cause the second formation to drive the first formation.

19. The control knob assembly as claimed in claim 16, wherein the second formation is adapted to be partially inserted into the first formation.

20. The control knob assembly as claimed in claim 19, wherein the first formation and the second formation are shafts.

21. The control knob assembly as claimed in claim 19, wherein the first formation is a generally D-shaped shaft.

22. The control knob assembly as claimed in claim 19, wherein the first formation includes a relief recess formed into a side thereof.

23. The control knob assembly as claimed in claim 16, wherein the first formation and/or the second formation is or are centrally located with respect to said skirt and/or said knob.

24. An appliance comprising the control knob assembly as claimed in claim 1, wherein the appliance is a gas appliance and the knob or the skirt is adapted to engage a stem of a gas valve of the gas appliance.

25. The control knob assembly as claimed in claim 1, wherein the knob includes a grip portion.

26. The control knob assembly as claimed in claim 1, wherein the skirt includes a rear face which in use will face the appliance, and rear extensions which extend away from the rear face beyond a rear rim of the skirt's side wall.

27. An appliance including at least one control knob assembly as claimed in claim 1.

28. The appliance as claimed in claim 27, wherein the appliance is a gas cooking appliance.

29. A control knob assembly to control an operation of an appliance, comprising:

a skirt adapted to engage the appliance, the skirt having a side wall, and a front face which in use will face away from the appliance;

a knob adapted to interact with the skirt, the knob having a side wall, the knob being adapted to move axially relative to the skirt; and a spring located between the knob and the skirt, to bias the knob and the skirt away from each other;

the skirt and/or the knob having a spring retaining means adapted to retain the spring, wherein the skirt includes a first formation, and the knob includes a second formation, wherein the first formation and the second formation are aligned so that one is at least partially received by the other, and wherein the first formation is a spigot, projection, shaft, or protrusion, and said second formation is an aperture or a recess.

30. A control knob assembly to control an operation of an appliance, comprising a skirt, a knob and a spring disposed therebetween and tending to bias the skirt and the knob axially away from each other;

said skirt having a side wall surrounding an inwardly extending flange, the side wall having a rear rim which in use will face toward the appliance, the flange having opposing front and rear faces which in use will face away from and toward the appliance, respectively, a plurality of rear projections extending from said rear face beyond, and located inwardly of, said rear rim, a first formation extending from said front face and adapted to cooperate with a complementary second formation on said knob, said first formation having a relief recess formed in a rim thereof effective to provide a relief area between said first formation and said second formation to ensure that they do not bind together or hinder axial movement of the knob relative to the skirt;

said knob having a side wall defining a recess portion adapted to at least partially receive and accommodate relative axial movement of the skirt, said second formation extending from a rear side of said knob and being aligned with said first formation such that one is at least partially received by the other;

one or both of said skirt and said knob comprising spring retaining means effective to retain the spring thereto and to maintain proper alignment and retention of said spring therewith upon disassembly of the knob from the skirt, said spring retaining means standing proud of a first, chamfered portion having a chamfered surface adapted to be engaged by a terminal end of said spring upon initial assembly of the spring thereto such that said terminal end is caused to expand radially from its natural resting state upon being advanced axially over said chamfered portion, and a second, grooved portion defining a retention groove into which said terminal end becomes received upon advancement beyond said chamfered portion, said retention groove possessing a diameter that is the same or less than the natural diameter of the terminal end of said spring.

31. The control knob assembly as claimed in claim 30, said spring retaining means comprising a plurality of L-shaped retaining formations, each said L-shaped retaining formation comprising an arm and a return elbow, said return elbow at least partially defining said chamfered surface, wherein a clearance between said return elbow and a surface from which said arm projects at least partially defines said retention groove.

* * * * *